United States Patent [19]

Fillmore et al.

[11] 4,408,700

[45] Oct. 11, 1983

[54] MULTI-PART DISPENSING CLOSURE HAVING A FRANGIBLE CONNECTING WEB

[75] Inventors: William E. Fillmore; George V. Mumford, both of Toledo; Ned J. Smalley, Perrysburg, all of Ohio

[73] Assignee: Owens-Illinois, Inc., Toledo, Ohio

[21] Appl. No.: 267,958

[22] Filed: May 28, 1981

[51] Int. Cl.[3] ..... B65D 47/26; B65D 47/36

[52] U.S. Cl. ..... 222/153; 222/522; 222/525; 222/541

[58] Field of Search ..... 222/520, 521, 522, 523, 222/525, 541, 153

[56] References Cited

U.S. PATENT DOCUMENTS

| | | | |
|---|---|---|---|
| 2,780,397 | 2/1957 | Larrabee | 222/539 |
| 2,834,520 | 5/1958 | Nyden | 222/525 |
| 2,901,153 | 8/1959 | Collins | 222/525 |
| 2,936,935 | 5/1960 | Rabb | 222/525 |
| 2,969,168 | 1/1961 | Newby | 222/525 |
| 3,107,829 | 10/1963 | Makowski | 222/525 |
| 3,204,835 | 9/1965 | Michel . | |
| 3,223,117 | 12/1965 | Curie et al. | 222/522 X |
| 3,276,640 | 10/1966 | Kessler | 222/525 |
| 3,366,289 | 1/1968 | Badavas et al. . | |
| 3,403,823 | 10/1968 | O'Donnell | 222/153 |
| 3,521,796 | 7/1970 | Roy | 222/525 |
| 3,834,597 | 9/1974 | Guala | 222/541 X |
| 3,998,354 | 12/1976 | Song | 222/541 X |
| 4,019,663 | 4/1977 | Krautkramer | 222/529 |
| 4,055,282 | 10/1977 | Komendowski | 222/525 X |
| 4,137,955 | 2/1979 | Carlson | 222/541 X |
| 4,196,819 | 4/1980 | Fontanaud . | |
| 4,231,486 | 11/1980 | Bock . | |

FOREIGN PATENT DOCUMENTS

| | | | |
|---|---|---|---|
| 1220045 | 5/1960 | France | 222/541 |

*Primary Examiner*—David A. Scherbel
*Attorney, Agent, or Firm*—J. R. Nelson; M. E. Click

[57] ABSTRACT

The disclosure relates to a unitary molded article and a method for producing a multi-part closure for assembly on the neck of a container, the closure involving an axially shiftable valve element which is movable between open and closed position. All parts of the multi-part valve element are integrally molded in a common molding cavity and the various relatively movable parts are interconnected by thin annular webs which are severed and the parts placed in proper operative condition during the assembly of the closure to the neck of a container by a conventional applicating machine.

4 Claims, 10 Drawing Figures

MULTI-PART DISPENSING CLOSURE HAVING A FRANGIBLE CONNECTING WEB

BACKGROUND OF THE INVENTION

1. Field of the Invention

The invention relates to a multi-part closure for assembly on the neck of a container, the closure involving an axially shiftable valve element which is movable between open and closed positions to permit selective dispensing of the product contained in the container. More specifically, the invention relates to a unitary molded article from which all parts of the multi-part closure may be assembled in proper relationship on the neck of a filled container during the normal closure applying operation.

2. Description of the Prior Art

There are a large number of prior art patents which disclose dispensing closures involving two or more separate parts, one of which is securable to the neck of a container, and at least one of the other parts is relatively movable with respect to the secured part to open and close a dispensing opening in the container to permit dispensing of the contents of the container.

It has been the practice heretofore to separately form each of the molded parts of the multi-part container by separate injecting molding operations, then assemble the multi-part container into a unitary structure and then, lastly, apply the preassembled closure to the neck of a filled container. Separate molding operations for each part of the multi-part closure, followed by assembly operations, are inherently expensive, and there is, accordingly, a need for a multipart closure which may be molded as a unitary article and assembled in proper functioning relationship during the normal application of the closure to a filled container by a conventional capping machine.

SUMMARY OF THE INVENTION

In accordance with the method of this invention, all parts of a multi-part dispensing closure for a container neck are concurrently molded in a single molding cavity from an elastomeric plastic material. The resulting article comprises a cap-shaped bottom element having a central sleeve in its panel portion defining a valve receiving dispensing opening. The one or more valve parts which cooperate with the dispensing opening are concurrently molded in an axially spaced, concentric relationship to the dispensing opening and connected to the cap portion of the dispensing closure by a thin annular web of the plastic material. If more than one valve component is required, the second valve component is similarly molded in axially spaced, concentric relationship to the first valve component and connected to the first valve component by a thin annular web of the plastic material.

The assembly of the molded parts into an operable dispensing closure is accomplished during the application of the cap portion of the closure to the neck of container. After such cap portion is applied to the neck threads, or otherwise secured to the neck by a conventional capping machine, an axial downward force is applied to the upwardly projecting valve components, which force is effective to sever the thin annular web connecting such valve components to the cap portion, and to move the valve components downwardly into their proper assembled relationship relative to the valve receiving dispensing opening in the cap portion.

Accordingly, it is an object of this invention to provide a less expensive method of fabricating and assembling a multi-part dispensing closure of the type that is formed by injection molding of elastomeric plastic materials.

A further object of this invention is to provide a unitary molded article having a container neck engaging portion at one end thereof which can be assembled into a fully operative dispensing closure through the application of an axial force to the top portions of the molded article.

Further objects and advantages of the invention will be readily apparent to those skilled in the art from the following detailed description, taken in conjunction with the annexed sheets of drawings, on which are shown several preferred embodiments of the invention.

DESCRIPTION OF THE PREFERRED EMBODIMENTS

Figure 1:
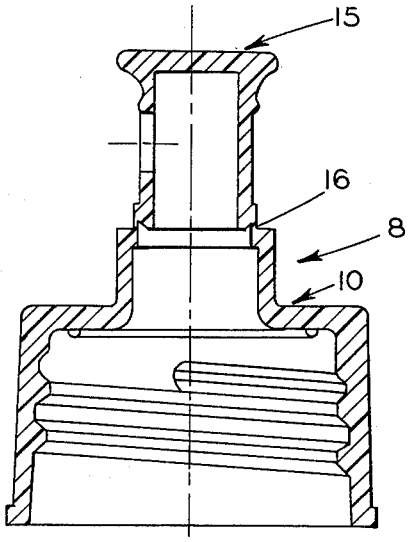
FIG. 1 is a vertical sectional view of a unitary molded plastic article embodying this invention.
Figure 2:
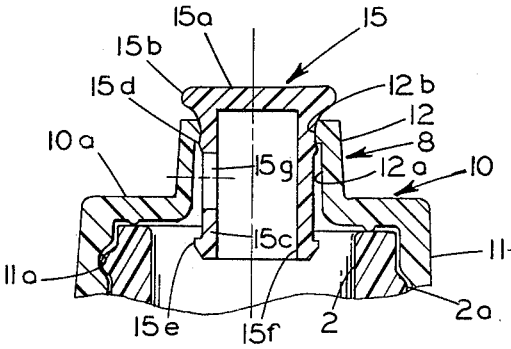
FIG. 2 is a sectional view of the plastic article of FIG. 1 after assembly onto the neck of a container and severing of the web connection between the closure portion and valve portion of the plastic article, the valve portion being shown in its closed position.
Figure 3:
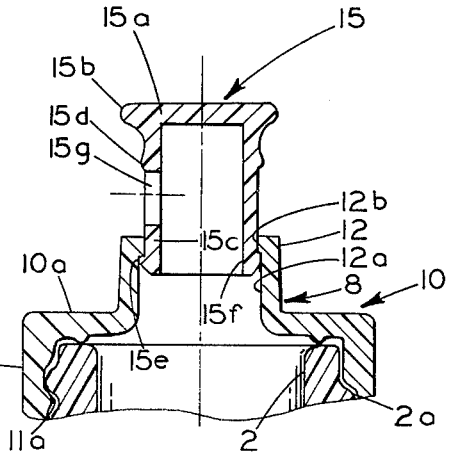
FIG. 3 is a view similar to FIG. 2 but with the valve portion of the dispensing closure shown in its open position.

For simplicity of understanding the principles of this invention, the various embodiments of dispensing closures will be first described in their fully assembled operative relationship on a container and then described in their "as molded" form when fabricated in accordance with this invention. Referring, therefore, to FIGS. 2 and 3, a dispensing closure 8 fabricated and assembled in accordance with this invention includes a cap part 10 having a panel portion 10*a* and a depending peripheral skirt portion 11 having internal threads 11*a* for securement to threads 2*a* provided on the neck portion 2 of a product filled container. It will be understood by those skilled in the art that the method of securely applying the cap portion 10 of the dispensing closure 8 to the neck 2 of the container forms no part of this invention, and a snap bead type of securement could be substituted for the threaded securement illustrated in the drawings. The central portion of cap 10 is formed as a vertically extending sleeve 12 defining a central axial bore 12*a*. Sleeve 12 is provided at its upper portions with an inwardly projecting shoulder 12*b* to function both as a resilient latch for retaining valve element 15 in its closed position and a stop preventing the inadvertent removal of a valve element 15 from bore 12*a*.

The valve element 15 is of sleeve like configuration having a closed upper end portion 15*a* having a radially projecting flange 15*b* permitting the top end of the valve 15 to be readily grasped by the fingers to be pulled upwardly to an open position. The sleeve portion 15*c* of valve 15 is snugly slidable within the bore defined by the internally projecting shoulder 12*a*. Sleeve portion 15*c* is provided with a pair of axially spaced, annular external ribs 15*d* and 15*e* which resiliently cooperate with the internally projecting shoulder 12*a* of sleeve 12 to position the valve in either its closed position as shown in FIG. 2, or in its fully opened position as shown in FIG. 3. In either event, the ribs 15*d* and 15*e* are distortable through the application of a sufficient axial force to radially compress and pass through the bore of the inwardly projecting shoulder 12*a*. Shoulder 12*a*, being fabricated of the same elastomeric type thermoplastic material is likewise expandable to facilitate such passage.

The valve 15 defines a central bore 15*f* communicating with the interior of the container and, hence, permitting the product contained in the container to readily pass into such bore. A radially disposed dispensing opening 15*g* is provided in the side wall of sleeve portion 15*c*. When the valve 15 is pushed axially downwardly to the limit permitted by the radially projecting top flange 15*b*, it will be apparent that the closure is in its sealed position and no product can escape therefrom. On the other hand, when the valve 15 is grasped by the fingers and pulled upwardly to the position indicated in FIG. 3, the radial dispensing port 15*g* is exposed and the contents of the container can readily be dispensed through such opening.

The method of fabricating and assembling the dispensing closure 8 shown in FIGS. 2 and 3, will now be described. First, the cap portion 10 and the valve portion 12 of the dispensing closure 8 are integrally molded in the same cavity by virtue of providing a connecting cavity defining a thin annular web portion 16 by which the valve element 15 is integrally connected to the cap portion 10 in an axially spaced, but coaxial relationship to such cap portion. The container is then filled with product in any conventional filling machine and the combined unitary cap and valve portions 10 and 15 are assembled to the container in a conventional closure applicating machine.

Figure 10:
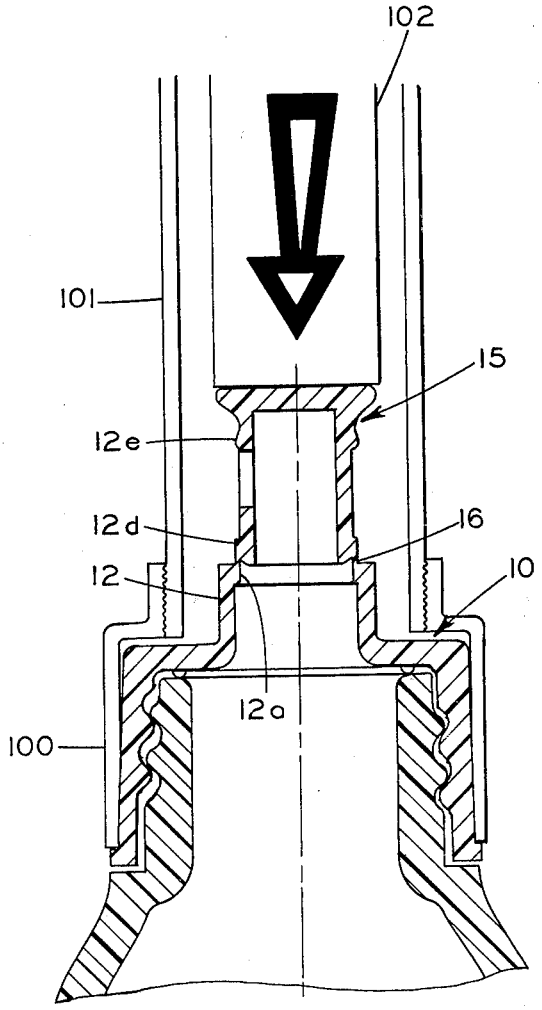
FIG. 10 is a schematic sectional view of a closure applicating head of a conventional closure applying machine showing the modification thereof to carry out the method of this invention.

As shown schematically in FIG. 10, closure applicating machines generally utilize a capping head 100 which is configured to engage the external periphery of the cap to be applied to the container. Such capping head is normally mounted on the bottom of a hollow shaft 101 which is moved axially and rotated by the machine elements in order to effect the rotational threading of cap portion 10 carried onto the threaded neck of a bottle. In accordance with this invention, a plunger 102 is appropriately slidably mounted within the bore of the hollow shaft 101 and is shifted downwardly by either a fluid operated piston (not shown) or by a camming mechanism riding on the circular camming rails normally provided in such capping machines so as to impart an axially downward force to the valve portion 15 immediately after the cap portion 10 of the dispensing closure 8 has been applied to the container neck. Such axial force will effect a severing of the web 16 which interconnects the cap portion 10 and the valve portion 15 and permits the valve 15 to be moved downwardly sufficiently to cause both the annular shoulders 15*e* and 15*d* to successively pass through the internally projecting shoulder 12*a* defined by the cap sleeve 12 and thus position the valve 15 in its closed position relative to the container, as shown in FIG. 2.

Figure 4:
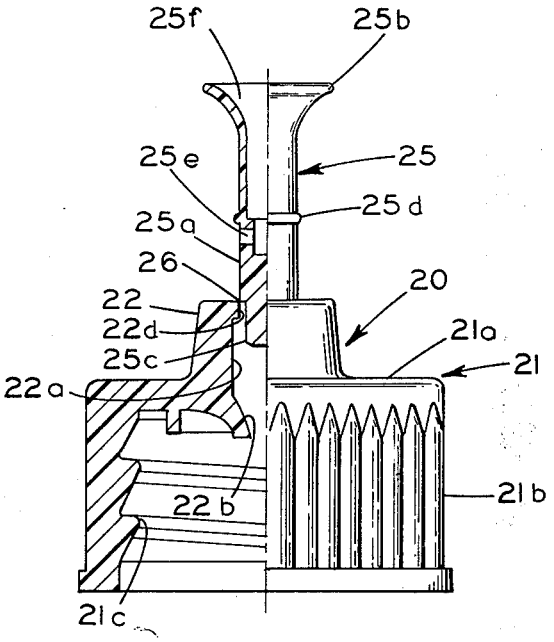
FIG. 4 is a vertical sectional view of a modified form of dispensing closure, showing the closure in its condition as originally molded.
Figure 5:
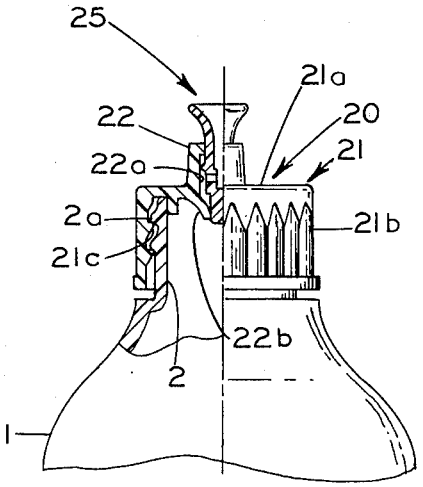
FIG. 5 is a reduced scale vertical sectional view showing the dispensing closure of FIG. 4 assembled to the neck of a container after severance of the web connecting the closure portion of the dispensing closure to the valve portion, the valve portion being shown in its closed position.
Figure 6:
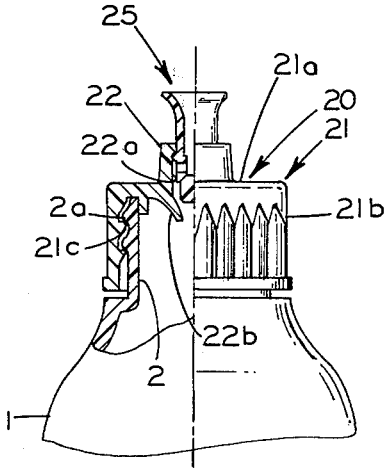
FIG. 6 is a view similar to FIG. 5 showing the valve portion of the dispensing closure in its open position.

Referring now to FIGS. 4 through 6, there is shown a modified form of two-piece dispensing closure which may be fabricated and assembled in accordance with this invention. Referring first to FIGS. 5 and 6, the dispensing closure 20 is shown in assembled relationship to the threaded neck 2 of a filled container 1, with the dispensing closure being shown in its closed position in FIG. 5, and in its opened position in FIG. 6.

The dispensing closure 20 includes a cap-shaped portion 21 having a panel portion 21*a* and a depending peripheral flange portion 21*b* defining internal threads 21*c* for cooperation with the container neck threads 2*a*. An integral vertical sleeve 22 is formed in the center of panel portion 21*a* and defines an axially extending bore 22*a*. The lower portions of sleeve 22 are formed as arcuately inwardly projecting portions 22*b* which function to achieve a seal with the bottom end 25*c* of the valve element 25 in the manner which will be hereinafter described. The top end of sleeve 22 defines an internally projecting annular shoulder 22*d* which functions as a resilient stop for upward movements of the valve element 25.

Valve element 25 is in the form of a plunger having a medial portion 25*a* slidably engaged by the bore of the internally projecting shoulder 22*a* of sleeve 22. The uppermost portion of plunger 25 is flared outwardly as indicated at 25*b* to provide a convenient grasping surface for the fingers to permit the valve 25 to be pulled upwardly to its opened position. The bottom portions of valve 25 are of reduced diameter as indicated at 25*c* and slidably and sealingly cooperate with the internally projecting portions 22*b* of the cap sleeve 22.

An external annular rib 25*d* is provided in the center of the plunger 25 to cooperate with the internally projecting flange 22*d* to resiliently hold the plunger 25 within the bore of the sleeve 22. Because of the elastomeric nature of the materials from which the cap portion 21 and the valve portion 25 are concurrently molded, the shoulder 25*d* will readily pass through the constriction provided by the bore of the internally projecting shoulder 22*d* through the application of a modest downward axial force.

The valve 25 is in its closed position when it is pushed downwardly sufficiently to engage the reduced diameter portion 25*c* with the inwardly converging portions 22*d* of the cap sleeve 22, as shown in FIG. 5. It is shiftable to its opened position by pulling it axially upwardly until the shoulder 25*d* engages the bottom face of the internally projecting sleeve shoulder 22*d*, as shown in FIG. 6. In this position, the product contents of the container can flow around the bottom end of the valve plunger 25 and then inwardly through one or more radial ports 25*e* provided in the wall of plunger 25 which communicate with a central dispensing bore 25*f*. Thus the product contents of the container may be readily dispensed through valve 25 when it is positioned in its opened position as illustrated in FIG. 6.

Referring now to FIG. 4, the dispensing valve 20 is shown in its "as molded" position wherein the valve plunger 25 and the cap portion 21 are concurrently molded in the same cavity and are interconnected by a thin annular web 26.

As in the previous modification, the cap portion 21 is assembled to the neck of a filled container and then an axial force is immediately applied to the top of valve plunger 25 to cause a severing of the web 26 and permit the valve plunger 25 to move downwardly to its assembled, operative position relative to the cap sleeve 22.

Figure 7:
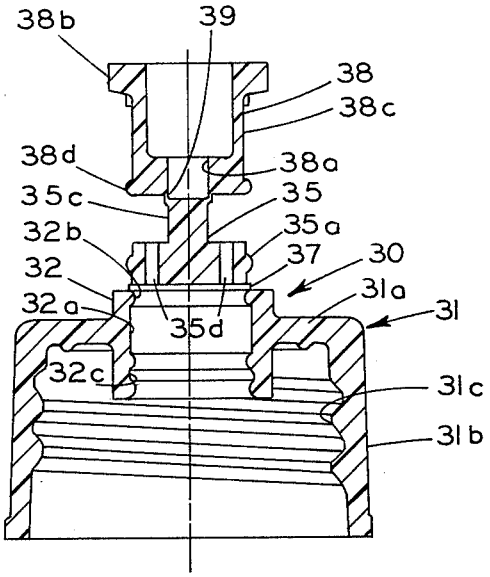
FIG. 7 is a vertical sectional view of a three-part dispensing closure in its, as molded, configuration.
Figure 8:
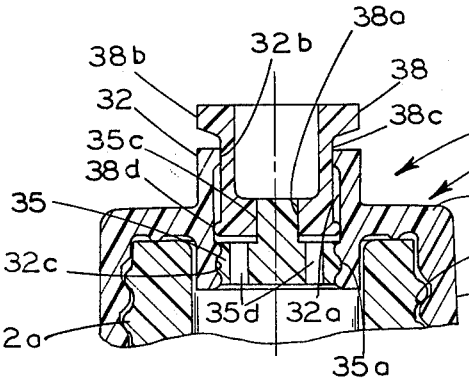
FIG. 8 is a vertical sectional view showing the dispensing closure of FIG. 7 assembled to the neck of a container and with the webs connecting the various valve elements severed and the valve elements positioned in their closed position.
Figure 9:
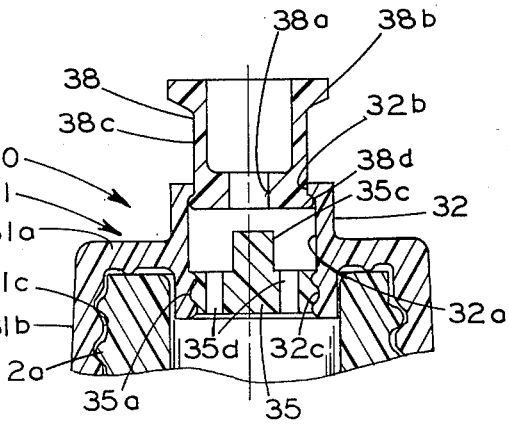
FIG. 9 is a view similar to FIG. 8 but illustrating the valve elements in their opened position.

Referring now to FIGS. 7–9, there is shown a still further embodiment of this invention wherein a three piece dispensing closure unit 30 is provided. Closure unit 30 comprises a cap portion 31 having a panel portion 31*a* and a depending peripheral skirt portion 31*b* provided with internal threads 31*c* for engagement with the container neck threads 2*a*. Cap portion 31 is further provided with a central sleeve portion 32 which defines an open bore 32*a* within which a two-piece valve element is mounted. An internally projecting shoulder 32*b* is formed at its upper end. One piece of such valve element comprises a plug portion 35 having a peripheral annular rib 35*a* cooperating with an internal annular recess 32*c* defined in the cap sleeve bore 32*a*. A plurality of upwardly extending fluid dispensing passages 35*d* are formed in the plug portion 35. The center of plug portion 35 is provided with an upstanding cylindrical plunger 35*c* upon which the second valve piece 38 is slidably mounted. The second valve piece 38 is of cup shaped configuration having a vertically extending bore 38*a* formed in its bottom portion and slidably receiving the plunger 35*c* therein in the closed position of the valve, as illustrated in FIG. 8. The top portions of the upper valve piece 38 are provided with an outwardly projecting shoulder 38*b* permitting convenient grasping by the fingers.

The side walls 38*c* of the upper valve part 38 slidably cooperate with the internal bore of the sleeve shoulder 32*b*. Adjacent the bottom end of the upper valve piece 38, an annular shoulder 38*d* is formed which provides a resilient stop for upward movement of the valve part 38 by engaging the underface of the internally projecting sleeve shoulder 32*b*. It will be readily apparent that when the upper valve piece 38 is pushed downwardly into the cap sleeve 32 so that the cylindrical projection 35*c* of the lower valve piece 35 engages the bore 38*a*, the closure is effectively sealed and no dispensing of the contents of the container can be accomplished. However, when the upper valve piece 38 is grasped by the fingers and raised to the position indicated in FIG. 9, the contents of the container can then flow through the vertical openings 35*d* provided in the lower valve piece 35 and thence through the now opened central bore 38*a* provided in the upper valve piece 38.

Referring now to FIG. 7, the dispensing closure 30 is fabricated by molding of an appropriate elastomeric plastic material in a single mold cavity. The lower valve piece 35 is integrally connected to the top end of the sleeve portion 32 of the cap 31 by a thin web 37. Similarly, the top end of the projection 35*c* of the lower valve piece 35 is connected by a thin annular web 39 to the bottom end of the upper valve piece 38. It will be noted that the resulting unitary article has all of the separate components thereof disposed in axially spaced, yet concentric relationship.

Accordingly, when the cap portion 31 is assembled to the neck of a container and an axial downward force is then applied to the top of the upper valve piece 38, the thin webs 37 and 39 will be severed and the valve components 38 and 35 will be moved axially downwardly into their assembled relationship within the cap sleeve 32 as illustrated in FIG. 8. It is preferred that the web 37 be made somewhat thinner than the web 39 so that this web severs first and permits the lower valve portion 35 to be inserted in the bore 32*a* of the cap sleeve 32 prior to severing of the connecting web 39. While this sequential severing of the webs is desirable, it is not necessary for the reliable assemblage of the dispensing closure 30 from the unitarily fabricated components shown in their "as molded" relationship in FIG. 7.

Further modifications and applications of the principles of this invention will be readily apparent to those skilled in the art. It is therefore intended that the scope of the invention be determined solely by the appended claims.

What is claimed is:

1. A unitary molded article of elastomeric material for forming a dispensing closure for a container neck, said article comprising a cap-shaped portion having a panel and a depending annular skirt constructed and arranged to snugly engage a container neck, said cap-shaped portion defining a vertical sleeve having a valve receiving opening, a hollow valve portion coaxially disposed relative to said skirt portion but axially upwardly spaced from said opening, said hollow valve portion initially comprising integrally molded components including a transverse cylindrical base portion snugly insertable in said vertical sleeve and having an upstanding plug and vertical dispensing openings below said plug; and a cup shaped portion having an open top bore, a vertical opening in its bottom portion adapted for sealing engagement with said plug and a severable web portion initially connecting said cap portion to said plug to maintain said cap portion in axially spaced relationship to said base portion, and a severable web portion joining said sleeve and said base portion, adapted to shear when a predetermined axial downward force is applied to said hollow valve portion thereby causing said hollow valve portion to move axially downwardly into said valve receiving opening to close said valve receiving opening in said cap portion, said hollow valve portion being vertically slidable in said sleeve when said web means is severed, said cup portion thereof having an external surface snugly engageable with the interior wall of said vertical sleeve, and retaining means on said sleeve engageable with said external surface of the cup shaped portion to resiliently retain the latter within said sleeve, whereby vertical movement of said cup shaped portion after severing thereof from said plug portion to a position above said plug portion permits product dispensing flow through said closure.

2. The article of claim 1 wherein said retaining means comprises cooperating annular rib and recess means provided on said valve portion and the bore of said sleeve to resiliently retain said valve in either said lower or said upper position within said sleeve after severing of said web means.

3. The article of claim 2 wherein said rib and recess means comprises an axially elongated annular recess in the bore of said sleeve defining a downwardly facing shoulder at its top portion, and a pair of axially spaced annular ribs on said valve projecting into said annular recess, the upper rib cooperating with said shoulder to resiliently secure the valve portion in its said closed position and the lower rib cooperating with said shoulder to limit the upward movement of said valve portion to said open position.

4. A unitary molded article of elastomeric material for forming a two-piece dispensing closure for a container neck, said article comprising a cap-shaped portion having a panel and a depending annular skirt constructed and arranged to snugly engage a container neck, said cap-shaped portion defining a vertical sleeve having a receiving opening, a valve coaxially disposed relative to said skirt portion but initially a substantial portion thereof axially disposed above said receiving opening, and an integral annular web portion initially joining said cap portion and said valve adapted to sever when a predetermined axial downward force is applied to said valve, said valve being vertically slidable in said sleeve when said web means is severed thereby causing said valve to move axially downwardly into said sleeve to close said valve receiving opening, an arcuately inwardly projecting annular sealing seat in the lower portion of said sleeve, said valve having an axial bore open at the top thereof and closed at a solid bottom plug portion, the latter being engageable with said annular sealing seat in sealing relation when said valve is in a lower closed position, said valve having a radial port connected to its axial bore above its said bottom plug portion and communicating with the open top bore thereof to permit product flow therethrough only when said valve is elevated within said sleeve relative to said annular sealing seat, an external rib on said valve above its said radial port, and retaining means internally of said sleeve engageable with said external rib to resiliently retain said valve within said sleeve in an open position, said valve being shiftable between said lower closed position sealing the sleeve by said solid plug portion and said open position permitting product flow out of said sleeve opening and through said radial port and axial bore of said valve.

* * * * *